US005975372A

United States Patent [19]

Heyn

[11] Patent Number: 5,975,372

[45] Date of Patent: Nov. 2, 1999

[54] METERING DISPENSER FOR LIQUIDS

[75] Inventor: Klaus Heyn, Waldbornstrasse, Germany

[73] Assignee: Zeller Plastik GmbH, Zell/Mosel, Germany

[21] Appl. No.: 09/051,039

[22] PCT Filed: Jan. 10, 1996

[86] PCT No.: PCT/EP96/04289

§ 371 Date: Jun. 1, 1998

§ 102(e) Date: Jun. 1, 1998

[87] PCT Pub. No.: WO97/12535

PCT Pub. Date: Apr. 10, 1997

[30] Foreign Application Priority Data

Oct. 2, 1995 [DE] Germany ..... 195 36 739

[51] Int. Cl.[6] ..... B67D 5/06

[52] U.S. Cl. ..... 222/181.3; 222/212

[58] Field of Search ..... 222/181.3, 212, 222/206, 215, 209

[56] References Cited

U.S. PATENT DOCUMENTS

| | | | |
|---|---|---|---|
| 2,784,882 | 3/1957 | Bois | 222/181.2 |
| 3,349,972 | 10/1967 | Whiteford | 222/212 |
| 3,545,651 | 12/1970 | Lewis | 222/181 |
| 4,650,095 | 3/1987 | Tella et al. | 222/181.2 |
| 4,905,873 | 3/1990 | Loesel, Jr. et al. | 222/212 |

FOREIGN PATENT DOCUMENTS

| | | |
|---|---|---|
| 0 530 789 | 3/1993 | European Pat. Off. . |
| 0 545 678 | 6/1993 | European Pat. Off. . |
| 33 39 064 A1 | 5/1985 | Germany . |
| 545 625 | 4/1974 | Switzerland . |
| 682 068 | 7/1993 | Switzerland . |

*Primary Examiner*—Steven O. Douglas

*Attorney, Agent, or Firm*—Woodcock Washburn Kurtz Mackiewicz & Norris LLP

[57] ABSTRACT

A dispenser for liquids is provided which allows for a dosage of arbitrary amounts of liquid, is easily operable by applying pressure and has a simple design. An integrated locking means is provided which secures the container of the dispenser to the mounting.

30 Claims, 10 Drawing Sheets

METERING DISPENSER FOR LIQUIDS

The present invention relates to a dispenser for liquids, in particular liquid soaps, shower gel, shampoo, disinfectants or the like comprising a mounting and a container.

Dispensers for liquids such as liquid soap or similar liquids are known. In dispensers used in wash-rooms or lavatories, a pump is frequently actuated via a key or lever using pressure or traction, which pump gives out some liquid from a container. In such dispensers, the pump is unremovably fixed to the housing, whereas the container is exchangeable. As a result, such a dispenser can only be used for one liquid since otherwise the pump would have to be continually cleaned. It is moreover disadvantageous that the pump staying in the dispenser becomes clogged or gummed up and, since such types of choking can serve as culture media for bacteria, the hygienic requirements are often no longer met. Frequent and complicated cleaning of the dispenser is unavoidable.

CH-A-547 625 discloses a dispenser for pasty liquids comprising a container and a mounting for the container. At its bottom side, the container is provided with a dispensing opening which is sealable by a valve. For dispensing an amount of the container contents, the container can be compressed anywhere.

CH-A-682 068 describes a dispenser in which the container is pivotably held at a wall surface by a suction cup.

In EP-A-0 530 789 a dispenser is suggested which includes a dispensing device which is fixed to the container and is exchanged together with the container. For mounting the container, a C-shaped holding element mountable to the wall is suggested in which the container is held with its upper and its lower end. For this purpose, a cap-like lid element is screwed at its lower end over the discharge device, which element is in turn clasped by a separate holding sleeve. This holding sleeve is fastened to the holding element via an integrated theft protection. The theft protection can be unlocked with an unlocking pin which can be introduced from outside. The two arms of the C-shaped holding element extend so far from the wall that a clamped-in cylindrical container can be encompassed and compressed by a hand. When the container is compressed, the deformation of the wall of the container is translated into an opening motion of the discharge device. As the container wall is compressed, a U-shaped holding bow mounted in the container is deformed such that a locking means connected to it is shifted and the outlet opening is cleared. The liquid to be dispensed flows out of the container until the relaxation of the container wall leads to the closing of the outlet opening via the locking means.

The dispenser described in EP-A-0 530 789 is disadvantageous in that exact doses can only insufficiently be measured. As soon as the outlet opening of the discharge device is cleared when the container wall is compressed, the liquid starts flowing out of the container at different velocities depending on its viscosity. This draining-off is not ended as long as the container is compressed.

Moreover, this dispenser is disadvantageous because of its complex and space-consuming structure. The dispenser is made up of a multitude of individual parts which have to be manufactured separately and moreover prolong the time of the assembly. Since the arms of the holding element have to be long enough for embracing the container, the arms extend relatively far into the room. Furthermore, a separate unlocking pin is necessary for unlocking.

In contrast, it is the object of the present invention to provide a dispenser allowing simple and effective dosage of different amounts of any viscous liquid. Moreover, a dispenser which is made up of a low number of individual parts and whose production and assembly is simple and inexpensive is to be provided. Such a dispenser is preferably space-saving and comprises a locking means. This object is achieved by the features of the claims.

The solution to the problem of the present invention is based on the following principle ideas.

The container of the dispenser according to the present invention comprises a front side, two side surfaces, a rear side as well as a bottom side. The front side is designed as a hand rest surface extending from the front bottom side to the top rear side. The two side surfaces are designed as elastic and curved gripping surfaces. These different sides are designed and adapted to each other such that dosage can be achieved simply by compressing the side surfaces and simultaneously touching the front side with one's hand.

The dispensing principle will be explained in the following.

The amount dispensed can be regulated by a differently strong or deep compression of the gripping surfaces. In particular, the dosage can be predetermined by a correspondingly geometrical design of the gripping surfaces. If a gripping surface is impressed, a corresponding excess pressure is generated within the container, which pressure is compensated for in that the self-closing dispensing device discharges liquid until the excess pressure is levelled out. The dispensing device closes as soon as a certain ratio between the pressure inside and the pressure outside the container is reached. Thus, the magnitude of the excess pressure determines the amount of liquid dispensed out of the container. Depending on the impression at the gripping surface, a certain amount of liquid flows out. If the excess pressure is levelled out, there is no further outflow even if the gripping surface is still constantly impressed. If, subsequently, the pressure on the gripping surfaces is relieved, their curves contribute to their return to their initial position while the dispensing device opens again and sucks air into the container to compensate for the partial vacuum now forming. Preferably, the seal described e.g. in EP-A-0 545 678 and comprising a self-closing valve can be used for this dispensing device. As regards its opening and closing properties, the valve is selected such that it is adapted to the desired dosage taking into account the viscosity of the contents.

Thus, the amount of liquid to be dispensed can be arbitrarily dosed and, since the outflow depends on the excess pressure generated by the compression, the danger of an unwanted bulky or even complete or even automatic emptying is not given.

The use of the self-closing valve known from EP-A-0 545 678 results in the following advantageous properties. The valve is opened when the first excess pressure is generated in the container and remains open even if the pressure gets lower and is closed again only if a second pressure, which is lower than the first excess pressure, is reached. In other words, this valve is opened by a certain pressure increase and closed by a certain pressure decrease. In this embodiment, the gripping surfaces are designed such that they can be compressed so far that the pressure increase necessary for opening the valve is reached. Moreover, the restoring force of the elastic gripping surfaces is selected such that the pressure decrease necessary for closing the valve is effected when the gripping surfaces are let go. The dosage in this connection is effected as a function of time, i.e. as long as the gripping surfaces are compressed, the contents of the container are dispensed. If the gripping surfaces are no longer compressed, the outflow is stopped.

At its side facing a wall, the container of the dispenser according to the invention comprises an integrated first holding device which is detachably engageable with a first receiving means provided at the mounting of the dispenser. Thus, the container is mounted to only one location of the mounting, which enables a simple exchangeability. Since on account of this kind of mounting there is no space between container and mounting, the dispenser according to the invention is particularly space-saving.

In order to reduce the individual parts necessary for the dispenser, the mounting only consists of the two parts, wall plate and lid element. The wall plate is fixed to the wall and comprises the aforementioned first receiving means, the lid element serves as a casing for the wall plate. The wall plate comprises an essentially arched holding arm and an adjoining essentially horizontal second receiving means. By means of this arched shape, a space is provided which leaves enough room for a hand collecting the liquid. For this purpose, the container, too, exhibits an arched form. By the assembly via the reverse side of the container, a sufficiently large supporting surface for compressing the container is provided at the container. The dispensing device is exchanged together with the container and, thus, the hygienic requirements are met. Moreover, cleaning is unnecessary.

According to a specific embodiment, the holding arm has an essentially U-shaped profile, thus providing sufficient space for an integrated locking means. The latter can invisibly be arranged in the mounting and thus serves as a theft protection. For simplification, the locking means is designed such that the container is released or unlocked via leverage by means of pressure from outside on the holding arm. For this purpose, the locking means consists of a locking and an unlocking portion. By the exertion of pressure on the unlocking portion, the locking portion is moved away from the container such that the lock-in connection between locking portion and container is released. The arrangement of the locking means completely within the mounting and its actuation by means of pressure from outside makes a separate additional unlocking device, such as a pin, superfluous and prevent the locking means from being visible from outside.

Moreover, the lock-in connection is designed such that both the holding pockets of the holding means, with which the locking portion is engaged, and the locking portion exhibit projections. If someone tries to remove to the top the container without actuating the theft protection, the two overlapping projections interlock and thus prevent the locking means from unintentionally sliding out of the holding pockets of the holding means.

The invention will be explained in detail in the following with reference to the drawings, in which.

Figure 1:
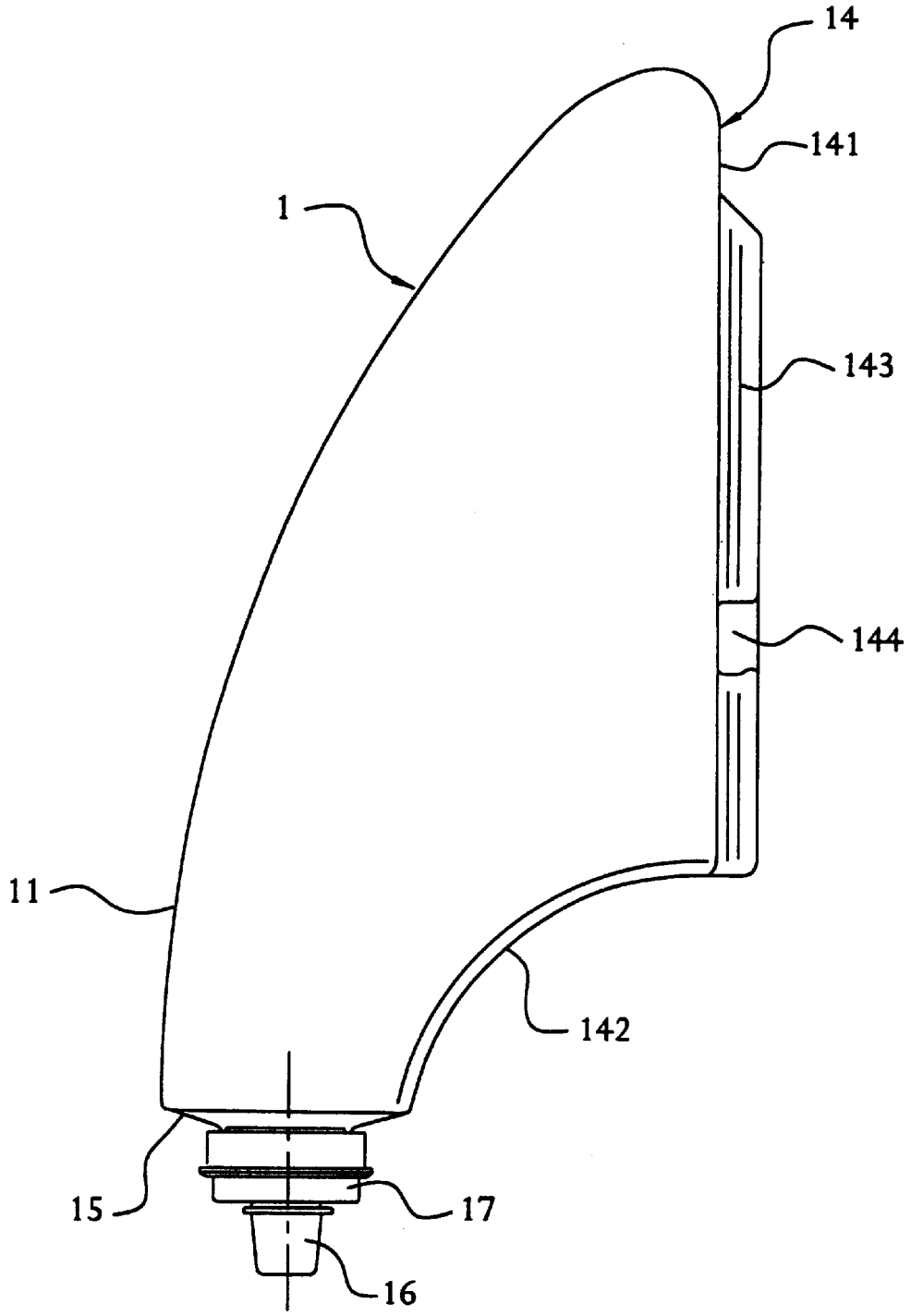
FIG. 1 is a side view of a preferred embodiment of a container comprising a dispensing device.
Figure 2:
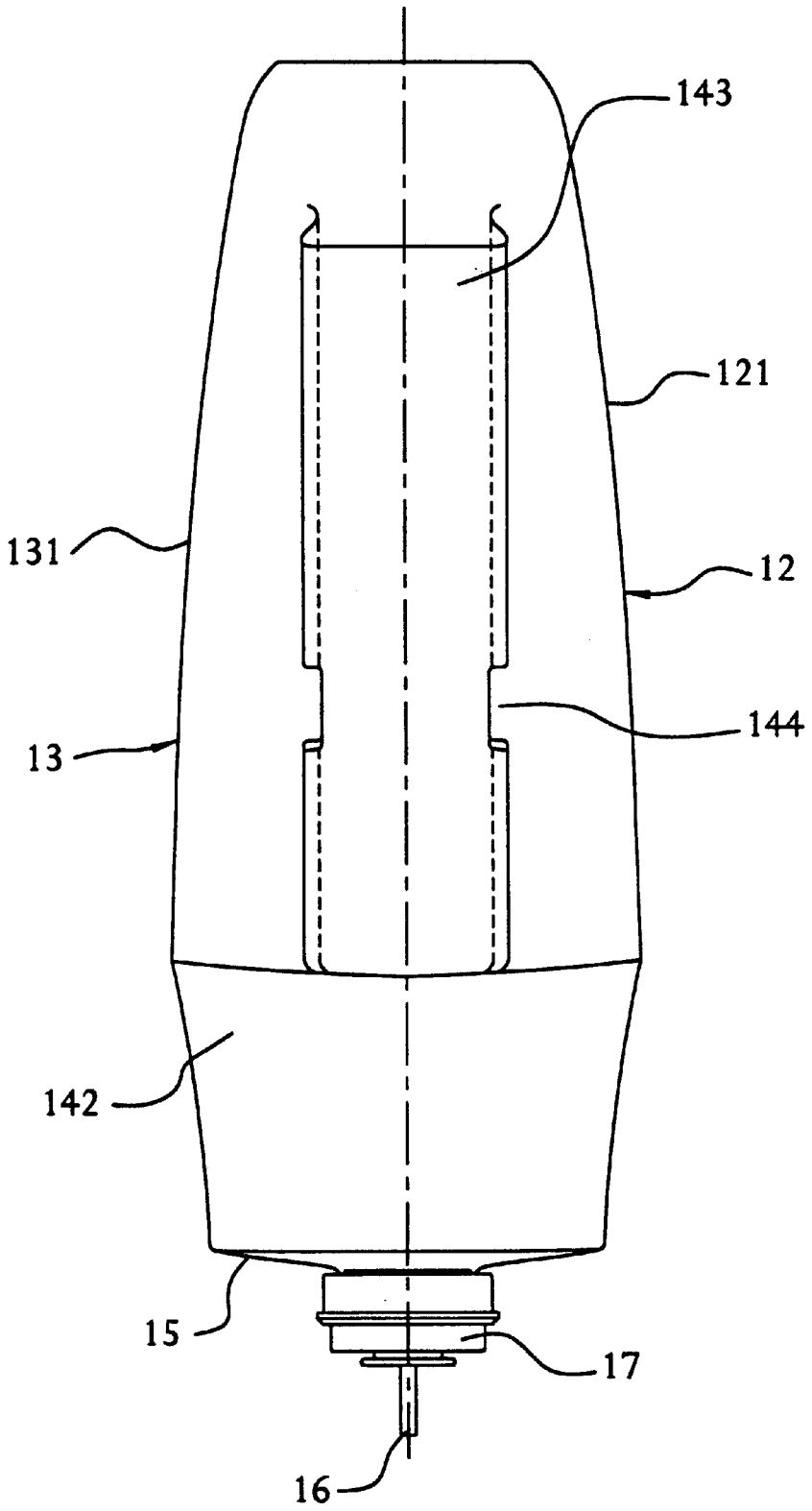
FIG. 2 is a rear view of the container of FIG. 1.
Figure 4:
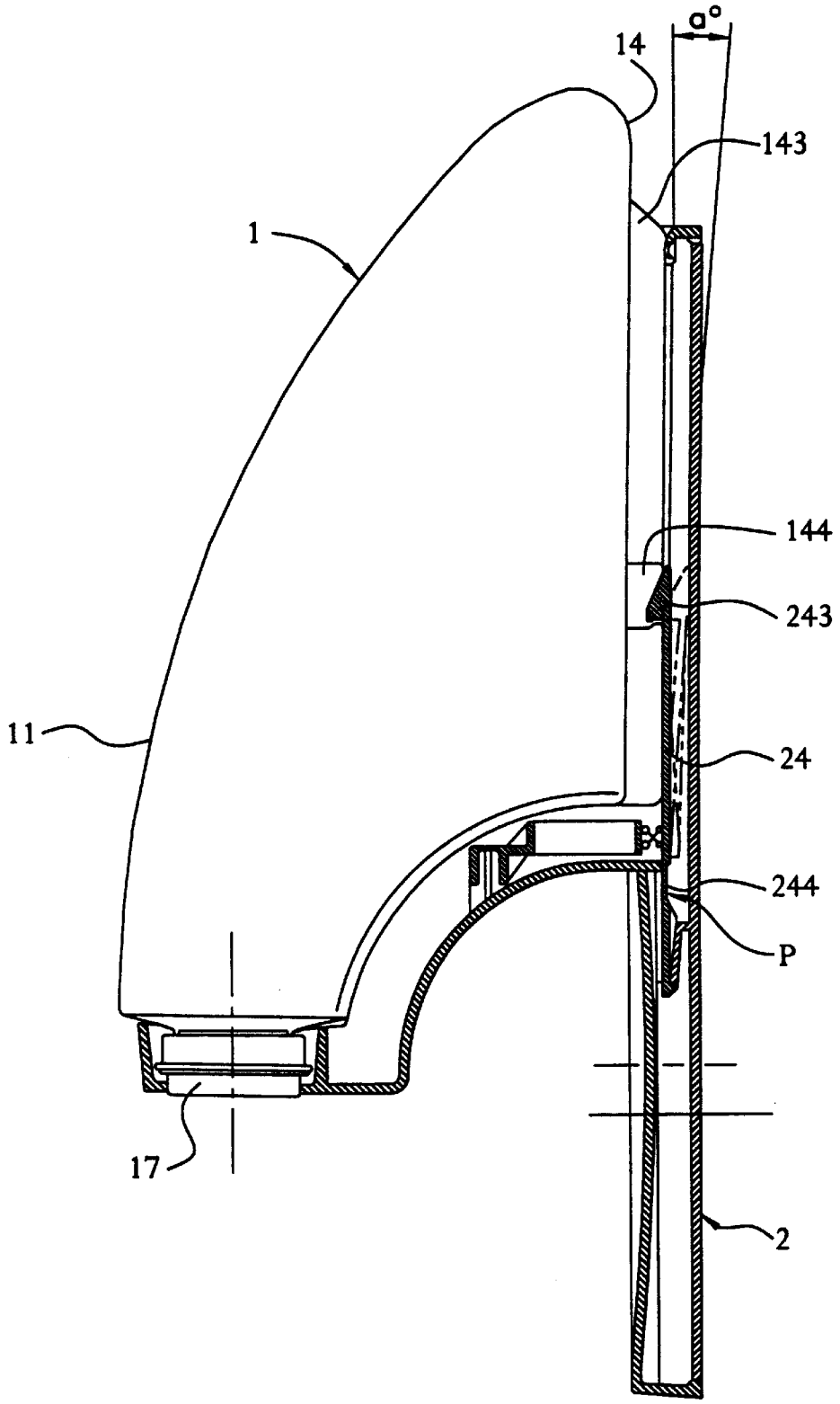
FIG. 4 is a side view of the container of FIG. 1 with a sectional view of the mounting.
Figure 6:
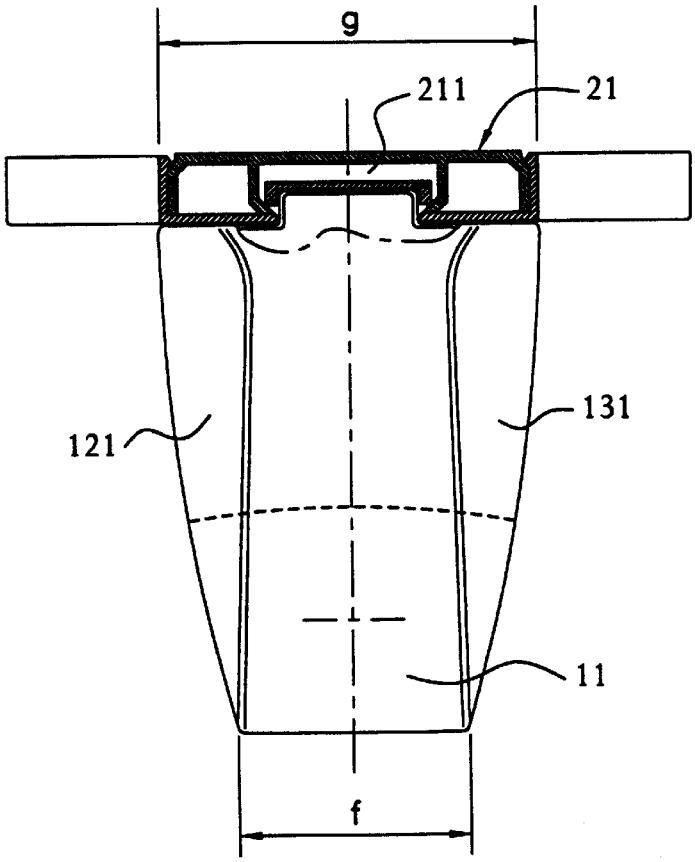
FIG. 6 is a top view of the device of FIG. 4 with a partial sectional view of the mounting in the area of the holding pockets.
Figure 6A:
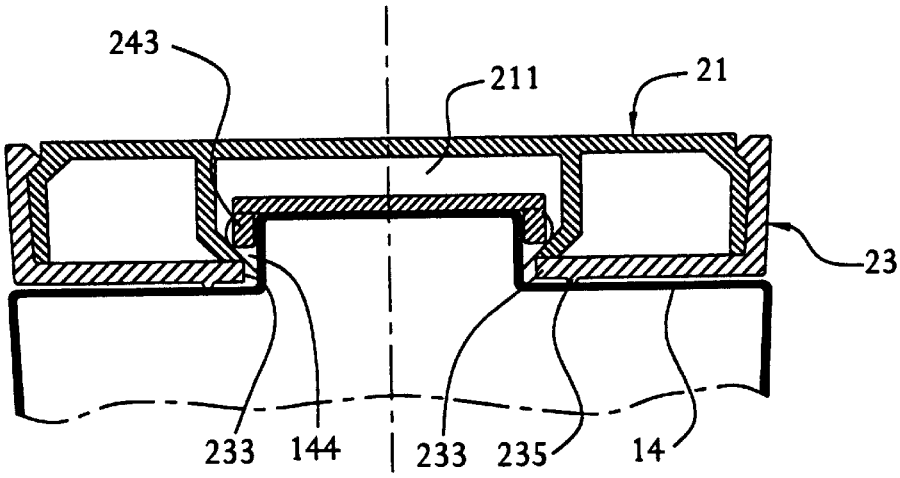
Figure 7A:
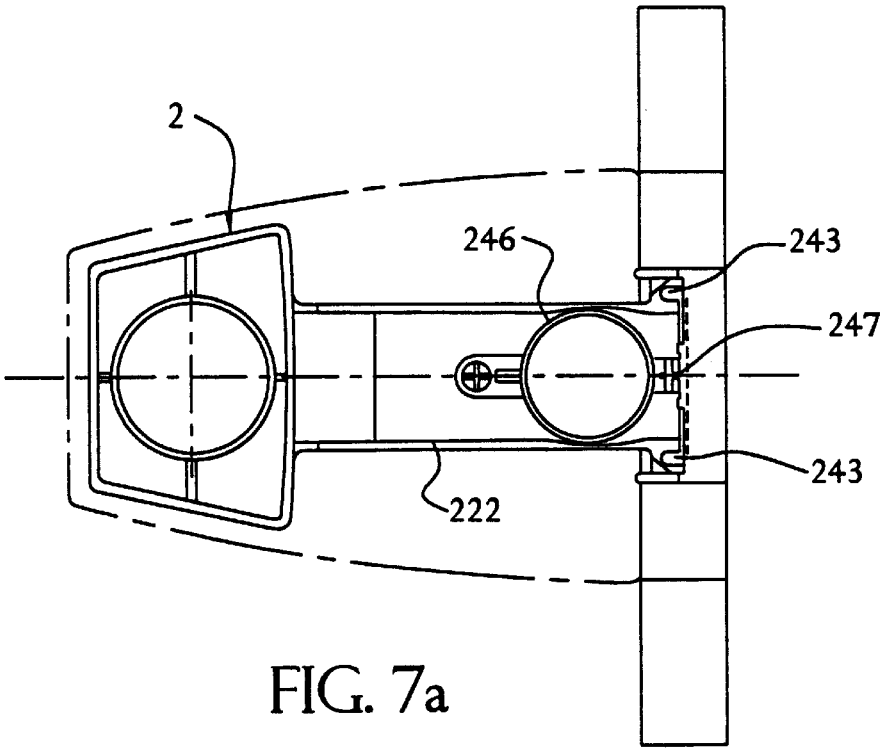
Figure 7B:
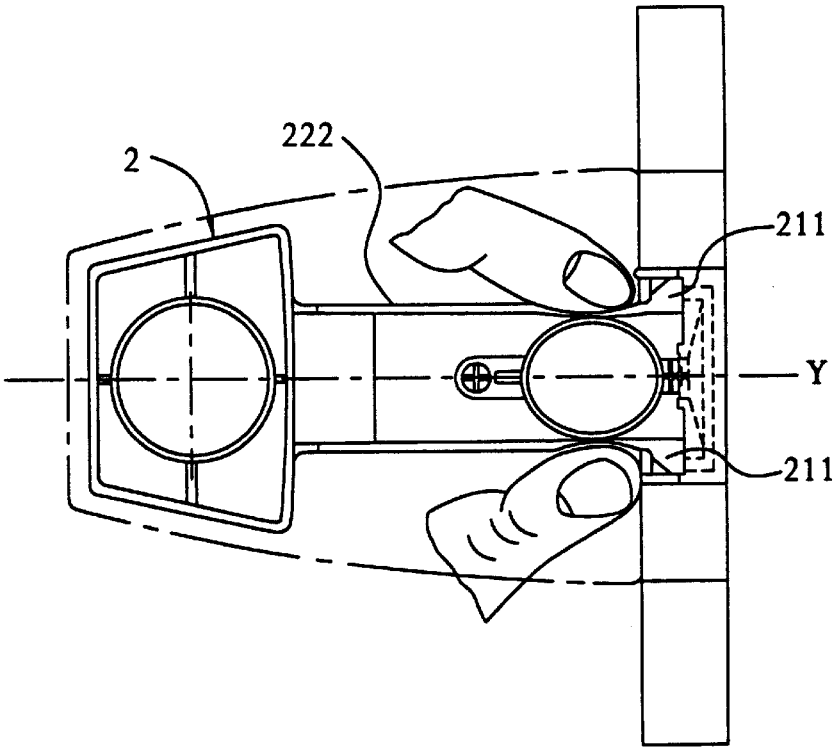
Figure 8:
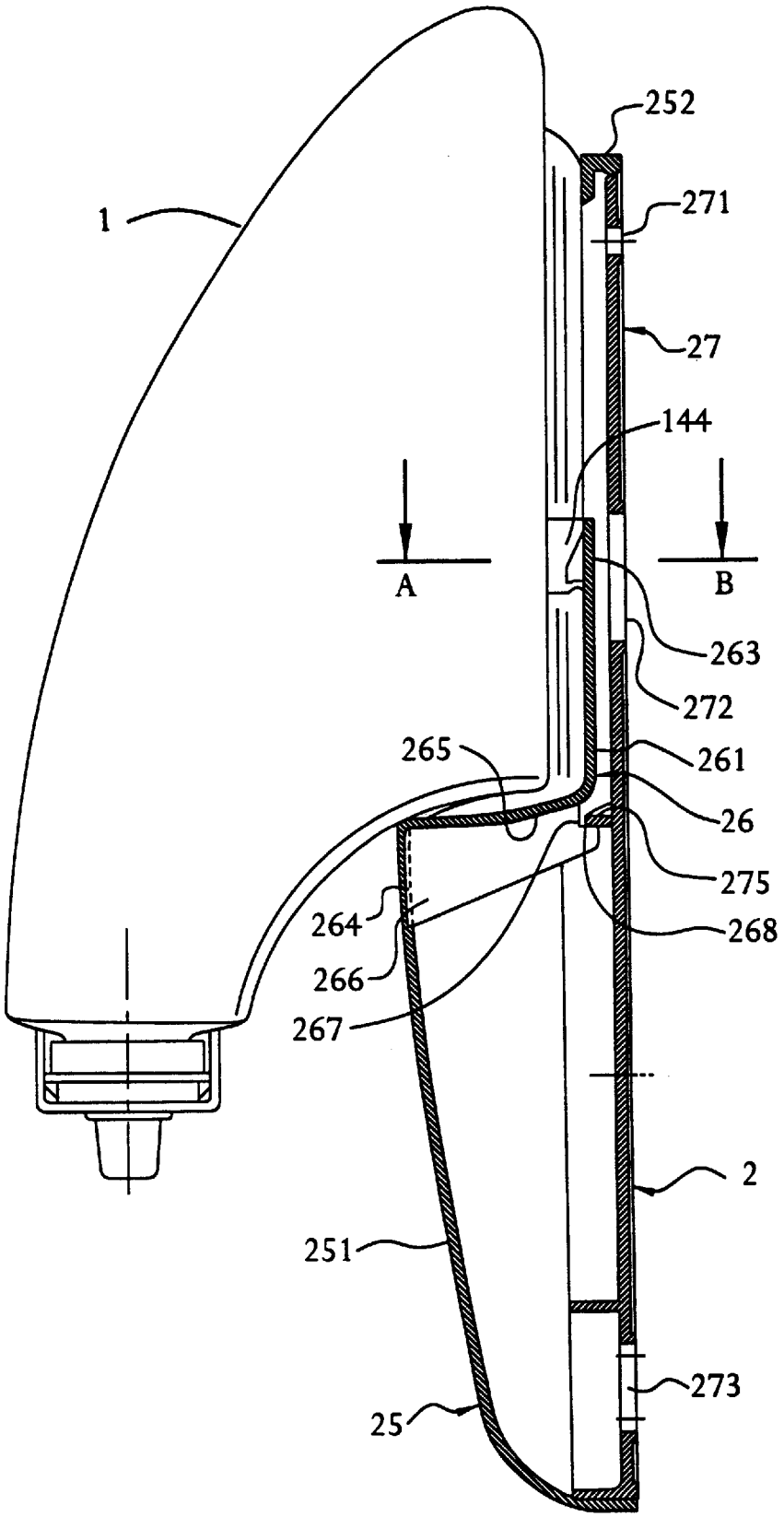
Figure 9:
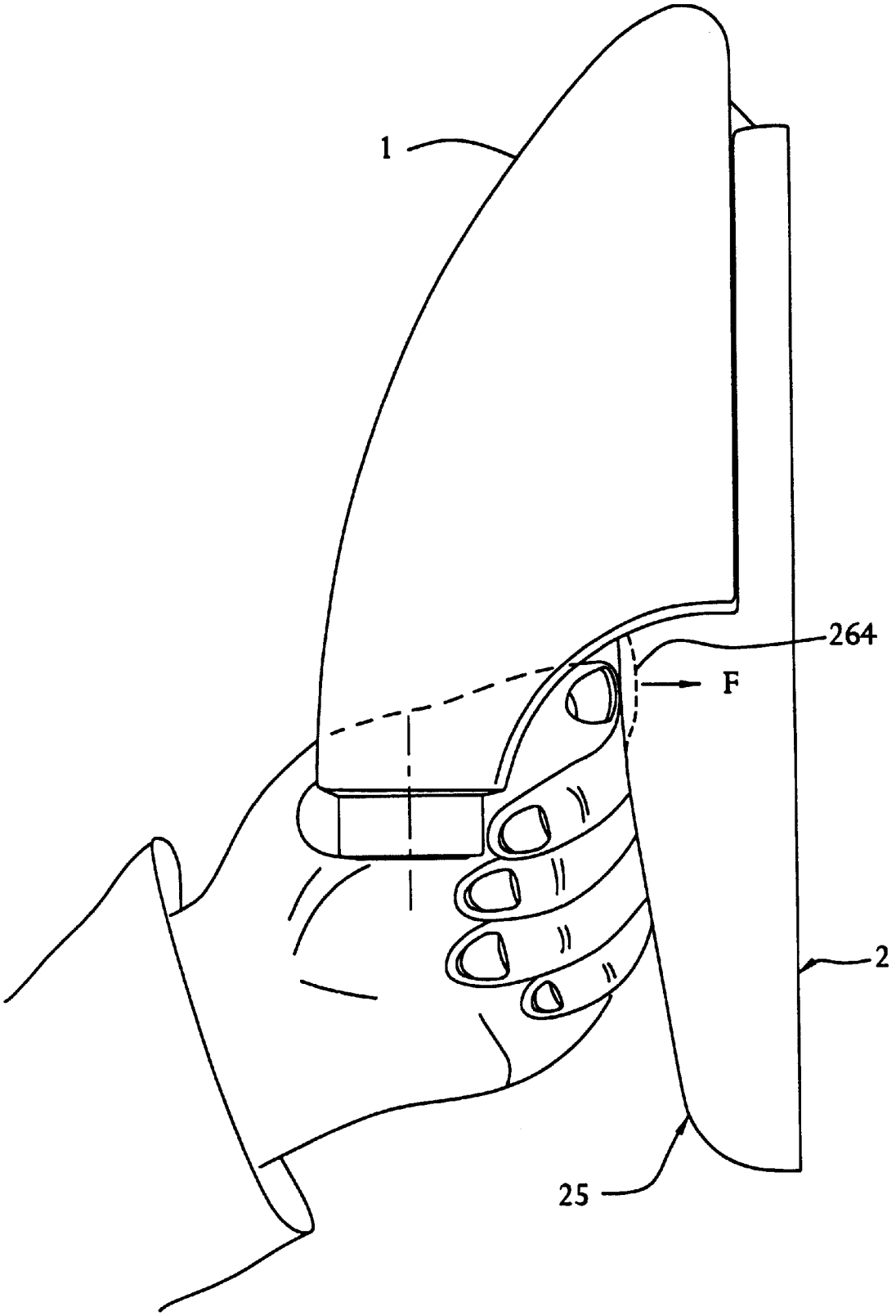
Figure 10A:
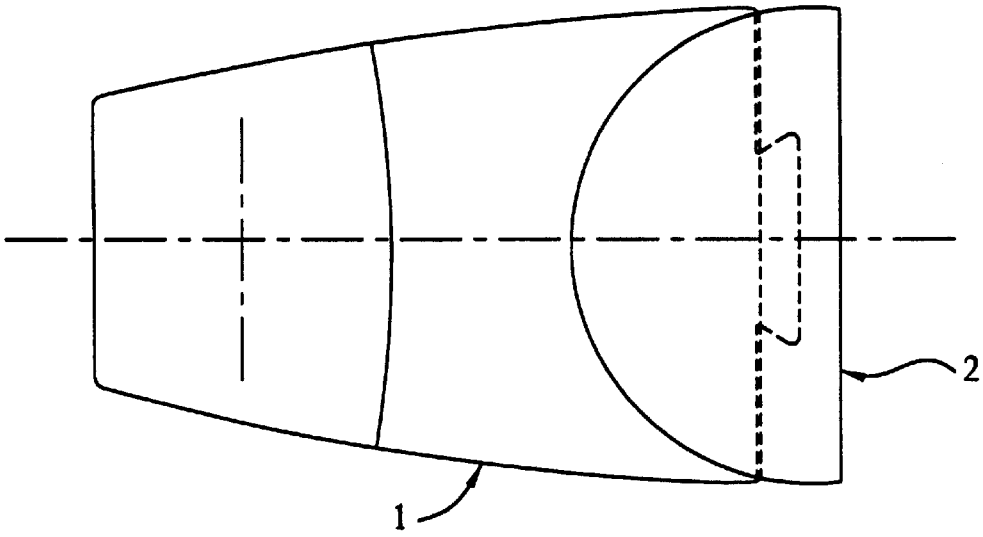

FIG. 6*a* is a selective enlargement of the partial sectional view of FIG. 6;

FIG. 7*a* is a top view of the mounting of FIG. 4;

FIG. 7*b* is a further top view of the mounting of FIG. 4, illustrating the operation of the unlocking mechanism of the locking means;

FIG. 8 is a side view of the container of FIG. 1 comprising a cross-sectional view of a further preferred embodiment of the mounting;

FIG. 9 is a side view of the embodiment of FIG. 8;

FIG. 10*a* is a bottom view of the embodiment of FIG. 8; and

Figure 10B:
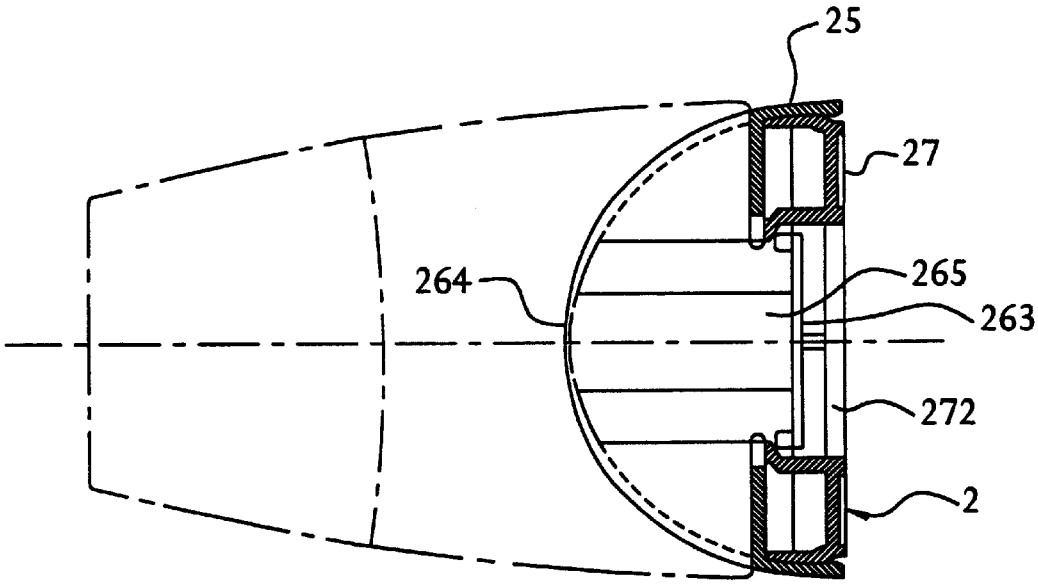

FIG. 10*b* is a cross-sectional view of the embodiment of FIG. 8 along the line A–B, in which the container is contoured by the dot-dash line.

FIG. 4 depicts a side view of a dispenser with a sectional view of mounting 2 in order to show the locking means 24 mounted therein as well. As shown in FIGS. 1 to 4, the container 1 has a specific shape characterised in that the side walls are not perpendicular or parallel to the mounting wall but their front portion is inclined in an arched way from bottom to top towards the wall. Since the liquid contained in the elastic container is to be tapped by the application of pressure, its cross-section is adapted to the shape of a hand grasping it, as evident from FIG. 6, in order to allow for a simple application of pressure.

At the lower end of the container, the dispensing device 17 is mounted, e.g. in form of an self-closing valve. The latter forms together with the container 1 a refillable unit which can be exchanged as a whole. The valve can be closed or secured with a tamper-proof seal 16 which can be removed via a predetermined breaking point and thus releases the valve opening.

At the sidewall 14 facing the wall, the first holding means 143 is situated which is provided for the assembly at the mounting 2 and exhibits e.g. a dovetail cross-section (cf. FIG. 6*a*). As a counterpart, the mounting 2 is provided with a groove 211 as a first receiving means which groove is adapted to the shape of the first holding means 143 and into which the container is vertically pushed such that it is detachably held. When the container is emptied, it can simply be removed from the mounting 2 with a movement towards the top after the release of the locking means, which will be described in the following, and replaced by a full container. The time for a necessary exchange can be determined via the level indicator 18 which is situated in a lower front portion of the container and thus clearly visible.

Figure 5:
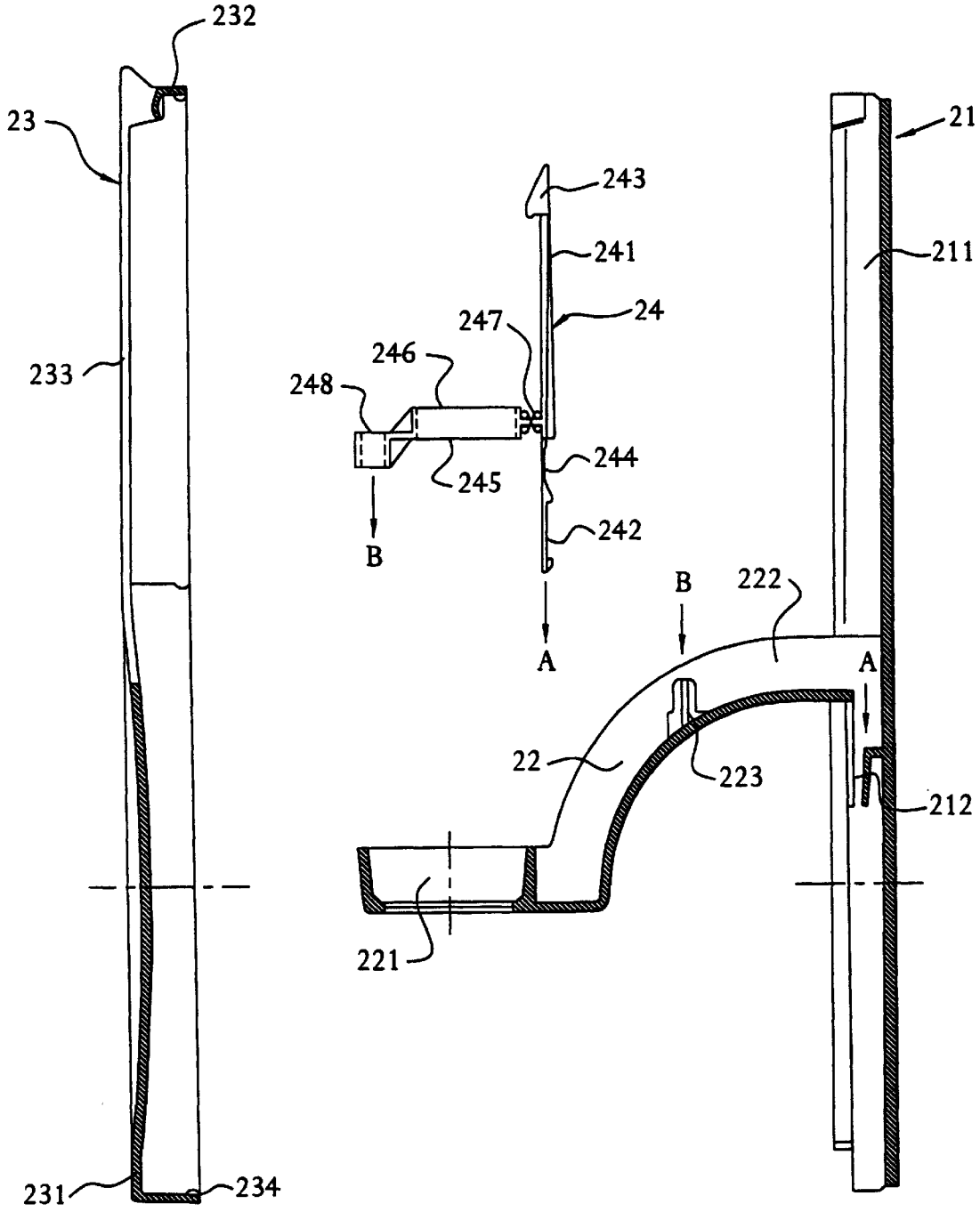
FIG. 5 is an exploded view of the mounting and the locking means of FIG. 4.

In the following, the design of the mounting 2 as shown in FIG. 5 will be explained in detail. The mounting 2 consists of the two parts wall plate 21 and lid element 23. Important components of the wall plate 21, which is suitably mounted to the wall, are the aforementioned first receiving means 211 in form of a groove and the projecting holding arm 22. The holding arm 22 is essentially composed of two sections, an arched portion 222 and an adjacent, essentially horizontal second receiving means 221. Preferably, the dispenser comprises a mounting of such shape and, in a lower portion 142, the shape of the container 1 is adapted to this holding arm 22.

If the container 1 is completely inserted along the groove 211 into the wall plate 21, its lower portion 142 rests on the holding arm 22, the dispensing device 17 then resting on the second receiving means 221. The shape of the latter is suitably adapted. The lower portion 142 rests on the arched portion 222. The latter preferably exhibits a U-shaped profile which is essentially open to the top and is thus covered by the container 1 and forms a cavity. The arched shape of the holding arm 22 provides a space between wall and valve on account of which a hollow hand can be held under the valve for collecting the liquid without difficulties. Thus, the dispenser can be operated with only one hand by holding the hand under the valve such that the liquid can be collected in order to simultaneously compress the gripping surface above it. It is, however, also possible to simply hold one's hand under the valve while one's other hand grasps the container 1 at a supporting surface 11 and compresses it at the gripping surfaces 121, 131.

The lid 23 is provided as a cover of the wall plate 21. The lid 23 is closed in a lower portion 231 and an upper portion 232. Between these portions 231, 232, an opening 233 is provided which matches the groove 211 and completes the groove as a direct counterpart of the first holding means 143 at the container 1. Moreover, the projections 235 are evident from FIG. 6*a*. In the area of the opening 233, they are parallel to the groove 211 and press the first holding means 143 via the elastic rear side 14 of the container 1 against the dovetail inclination of the groove 211 leaving no play.

For mounting the lid element 23 to the wall plate 21, the lid element 23 is first shifted with the opening 233 crosswise over the second receiving means 221, turned in the area of the holding arm portion 222 to the perpendicular and, finally, engaged with the wall plate 21 via the preferably circumferential snap-in connection 234 such that it is held by the latter.

The container is thus shifted within the groove 211 so far to the bottom until the valve rests in the receiving means 221 and the U-shaped holding arm portion 222 is covered. Then, the container is in its final position.

As mentioned above, the supporting surface 11 has a specific shape and is tilted to the top towards the wall. Preferably, it is provided with elastic gripping surfaces 121, 131 laterally facing each other as points of contact for compressing the container 1, which gripping surfaces are curved in order to effect the resetting of the container walls after compression. In the front portion of the container, the supporting surface 11 exhibits a width f of about 10 to 50 mm, preferably 37 mm, in the rear portion the width g is approximately 40 to 100 mm, preferably 62 mm. The width f is preferably 25 mm larger than the width g.

Figure 3:
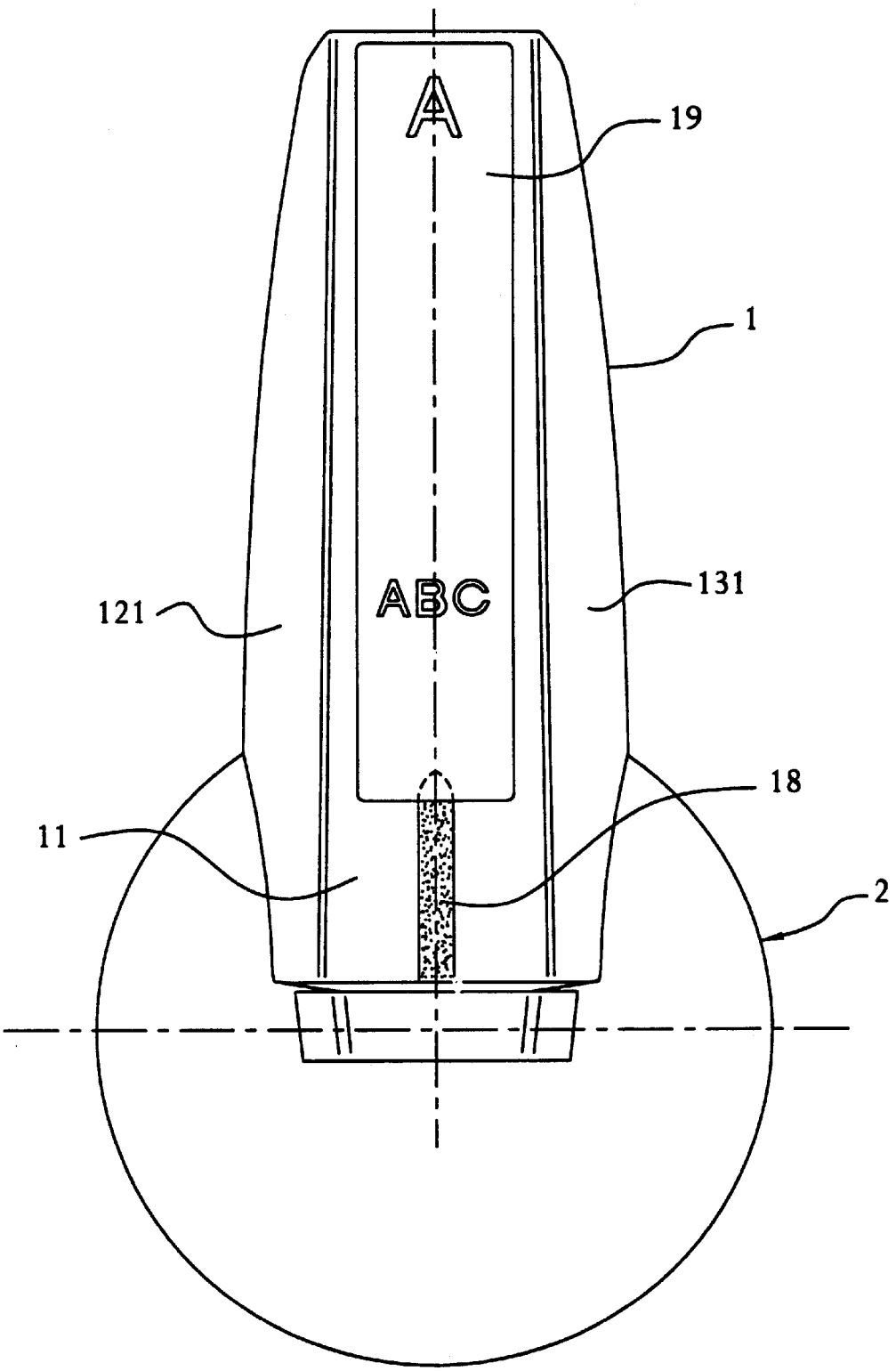
FIG. 3 is a front view of the container of FIG. 1 held in the mounting.

The supporting surface 11 shown in FIG. 3, is also used for labelling the container 1, preferably with an adhesive label 19. The position and the length of this label determines the visible portion of the level indicator 18 and thus the visible residual amount of the container contents.

Subsequently, the design and construction and the mode of operation of the locking means 24 will be discussed in more detail. As shown in FIG. 5, the locking means 24 consists of the locking portion 241 and the unlocking portion 245. The locking means 24 is placed perpendicularly upon the wall plate 21 and held by the latter at the points A and B. The locking means is on the one hand mounted to the wall plate via a snap-in connection at the lower end of the locking portion 242 and on the other hand via a support bearing within the holding arm 22 at point B. The actual locking is effected via a further lock-in connection element 243 at the upper end of the locking portion 241, which lock-in connection element snaps into the holding pockets 144 of the first holding means 143 upon the introduction of the container 1 into the groove 211 of the mounting. For this purpose, the locking portion 241 is in one section designed as a spring element 244 which prestresses the lock-in connection element 243 towards the holding pocket 144. The unlocking portion 245 of the locking means 24 essentially consists of a cylindrical, preferably round section 246. The latter is connected with the locking portion 241 via a hinge-like thin location 247 and has such a diameter that it fits closely to the inside of the arms of the U-shaped portion 222, as shown in FIG. 7*a*. If the holding arm portion 222 is compressed in the direction of the arrow in the area of the unlocking portion as shown in FIG. 7*b*, this compression effects an extension of the cylindrical portion in the direction of the y-axis. Due to this movement, in turn, the locking portion 241 turns around a point in the area of the spring element 244 about an angle α. The lock-in connection between the locking means 24 and the container 1 is released and the container can be removed to the top.

FIGS. 8, 9, 10*a* and 10*b* depict a dispenser with an alternative embodiment of the mounting 2. In detail, the mounting 2 consists of a wall plate 27 and a lid element 25. The wall plate 27 is provided with mounting holes 271 and 273 arranged in the area of the upper and the lower end of the wall plate, respectively. Moreover, an opening 272 is provided in the area of the upper third of the wall plate. The lid element 25 is held at the upper or lower end of the wall plate 27 by the snap-in connections 252 or 254, respectively. In contrast to the embodiment described above, the locking means 26 is an integral part of the lid element 25. A lower portion 251 of the lid element 25 extends from the bottom side to the front top and ends approximately at the height of the middle of the wall mounting. At the upper end, a step is provided on which the bottom side of the inserted container 1 rests. A middle section in the area of the upper end is designed as a spring element 264. As in particular evident from FIG. 9, this spring element 264 is compressible in the direction F towards the wall mounting. Starting from this spring element, an unlocking portion 265 extends towards the inside and subsequently a panel-shaped locking portion 261 extends to the top. A perpendicular stiffening portion 266 having stop faces 267 and 268 is connected to the unlocking portion 265. The upper end of this stiffening portion is provided with a lock-in connection element 263 which is engaged with the holding pockets 144 at the container. When the middle portion 264 is compressed, the stop face 267 is pressed to the projection 275 as a lift stop. Thereby, the locking is released and the container can be removed to the top. During compression, the lock-in connection element 263 is pressed into the area of the recess 272 in the wall plate 27. Due to its inherent elasticity the middle portion recovers its initial position and, if a new container is inserted, the lock-in connection element 263 snaps into the respective holding pockets 144.

If someone tries to pull the container 1 out of its mounting without unlocking it, the stop face 268 will dash from the bottom against the projection 275 and thus avoid the generation of deforming tensile forces onto the lid element 25.

In all other respects as to the design and construction and the mode of function, it can be referred to the above description of the first embodiment. The second embodiment is advantageous in that its locking means does not require an additional component.

I claim:

1. A dispenser, in particular for pasty liquids, comprising a container (1) and a mounting (2) for the container, wherein the container comprises a front side (11), first and second side surfaces (12, 13), a rear side (14) and a bottom side (15) and wherein a dispensing opening (16) which can be sealed by a self-closing valve (17) is provided at the bottom side (15); the front side forms a supporting surface (11) which extends from the bottom side (15) to the top and towards the rear side (14); and the first and/or second side surface(s) (12, 13) exhibit(s) an arched outwardly, elastic gripping surface (121, 131) whose radius of curvature increases from the edge of the supporting surface (11) to the edge of the rear side (14) and which increases the pressure within the container and opens the valve for dispensing an amount of the container contents by pressing it.

2. The dispenser according to claim 1, wherein the supporting surface (11) is arc-shaped, the radius of curvature preferably decreasing from the bottom side (15) to the rear side (14).

3. The dispenser according to claim 1, wherein the supporting surface (11) takes an essentially straight course transverse to its direction of extension.

4. The dispenser according to claim 1, wherein the width of the supporting surface (11) increases from the bottom side (15) to the rear side (14), preferably starting with a width f of 10 to 50 mm, in particular 37 mm and ending at a width g of 40 to 100 mm, in particular 62 mm.

5. The dispenser according to claim 1, wherein the rear side (14) comprises an upper portion (141) which is essentially plain and an adjoining lower portion (142) which is arc-shaped, the arc being curved preferably in the same direction as the supporting surface (11).

6. The dispenser according to claim 1, wherein a first holding means (143) is provided at the rear side (14).

7. The dispenser according to claim 6, wherein the first holding means (143) is designed as a projection extending in the longitudinal direction over at least part of the rear side (14) and preferably having a dovetail cross-section.

8. The dispenser according to claim 6, wherein the mounting (2) comprises a first receiving means (211) engageable with the first holding means (143).

9. The dispenser according to claim 8, wherein the first receiving means is a bar (211) whose length and cross-section are preferably adapted to the dimensions of the holding means (143).

10. The dispenser according to claim 1, wherein the self-closing valve (17) and opens at least when a certain internal pressure in the container is reached.

11. The dispenser according to claim 1, wherein the valve (17) is secured by means of a tamper-proof seal (16).

12. The dispenser according to claim 1, wherein the container (1) comprises at least one portion (18), preferably in the lower section of the supporting surface (11), which portion is transparent.

13. The dispenser according to claim 1, wherein the supporting surface (11) is provided with a label (19).

14. The dispenser according to claim 13, wherein the label (19) at least partially overlaps the transparent portion (18).

15. The dispenser according to claim 1, wherein the mounting (2) comprises a wall plate (21) mountable to a wall, with a holding arm (22) extending from the wall and a lid element (23) mountable to the wall plate (21).

16. The dispenser according to claim 15, wherein the holding arm (22) is provided at its free end with a second receiving means (221) for the dispensing device (17) of the container (1).

17. The dispenser according to claim 15, wherein the holding arm (22) comprises an arched portion (222) extending essentially at a right angle from the wall plate (21) towards the bottom and an essentially horizontally adjoining second receiving means (221).

18. The dispenser according to claim 17, wherein the arched portion (222) has an essentially U-shaped cross-section open to the top.

19. The dispenser according to claim 17, wherein the lower portion (142) of the side of the container (1) facing the mounting (2) is designed such that its course corresponds to the shape of the holding arm (22) and rests on the latter.

20. The dispenser according to claim 15, wherein the lid element (23) is provided with projections (235) which interact with the rear side (14) of the container (1) and thus enable the container (1) to be mounted in the mounting (2) without play.

21. The dispenser according to claim 1, wherein the mounting (2) comprises a locking means (24, 26) engaging between the mounting (2) and the rear side (14) of the container (1).

22. The dispenser according to claims 21, wherein the locking means (24) is arranged within the mounting (2) such that it is unrecognisable from outside, the locking portion (241) being preferably arranged within the wall plate (21) and the unlocking portion (245) within the U-shaped portion (222).

23. The dispenser according to claim 21, wherein the locking means (24) comprises a panel-shaped locking portion (241, 261) and an unlocking portion (245, 265) which is preferably adjacent to the first end (242) of the locking portion (241) and can be swivelled.

24. The dispenser according to claim 23, wherein the locking portion (241) is engageable with its first end (242) with a support bearing (212) in the area of the holding arm (22) at the wall plate (21) such that by actuating the unlocking portion (245) the second end (243) of the locking portion (241) is pivotable.

25. The dispenser according to claim 23, wherein the second end of the locking portion (241) is provided with a lock-in connection element (243) which is detachably engageable with a recess (144) at the rear side (14), preferably at the holding means (143).

26. The dispenser according to claim 25, wherein the lock-in connection element comprises a nose (243, 263) which is engaged with the holding pocket (144) such that they interlock and the container (1) cannot be removed from the mounting (2) without releasing the unlocking means (24).

27. The dispenser according to claim 23, wherein the locking portion (241, 261) comprises a spring element (244, 264) such that the lock-in connection element (243, 263) is pivotable.

28. The dispenser according to claim 23, wherein the unlocking portion (245) comprises a cylindrical portion (246) which is connected to the locking portion (241) via a joint (247) and a mounting (248) at a location opposite the joint (247).

29. The dispenser according to claim 28, wherein the mounting (248) of the unlocking portion (245) is connectable to a support bearing (223) at the arched portion (222).

30. The dispenser according to claim 28, wherein the cylindrical portion (246) is elastically bendable such that pressure on the cylindrical portion (246) is transmitted to the locking portion (241) such that the lock-in connection element (243) is moved out of the recess (144).

* * * * *

UNITED STATES PATENT AND TRADEMARK OFFICE

CERTIFICATE OF CORRECTION

PATENT NO. : 5,975,372

DATED : November 2, 1999

INVENTOR(S) : Heyn

It is certified that error appears in the above-identified patent and that said Letters Patent is hereby corrected as shown below:

Cover Page, beneath "FOREIGN APPLICATION PRIORITY DATA" delete "195 36 739" and insert --195 36 739.1-- therefor.
Cover Page, beneath "FOREIGN PATENT DOCUMENTS" delete "545 625" and insert --547 625-- therefor.
Column 3, Line 41, delete "prevent" and insert --prevents-- therefor.
Column 3, Line 46, delete "to remove to the top the" and insert --to remove the top of the-- therefor.
Column 4, Line 16, delete "characterised" and insert --characterized-- therefor.
Column 4, Line 25, delete "an self-closing" and insert -- a self-closing-- therefor.
Column 6, Line 26, delete "As in particular evident" and insert --As is particularly evident-- therefor.
Column 7, Line 2 of Claim 10, delete "and opens" and insert --opens-- therefor.
Column 8, Line 1 of Claim 22, delete "claims 21," and insert --claim 21,-- therefor.
Column 8, Line 3 of Claim 22, delete "unrecognisable" and insert --unrecognizable-- therefor.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*